US008060255B2

(12) United States Patent
Wieland

(10) Patent No.: US 8,060,255 B2
(45) Date of Patent: Nov. 15, 2011

(54) SYSTEM AND METHOD OF DISTRIBUTED CONTROL OF AN INTERACTIVE ANIMATRONIC SHOW

(75) Inventor: Alexis Paul Wieland, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 1098 days.

(21) Appl. No.: 11/854,451

(22) Filed: Sep. 12, 2007

(65) Prior Publication Data

US 2009/0069935 A1 Mar. 12, 2009

(51) Int. Cl.
*G05B 19/04* (2006.01)

(52) U.S. Cl. ..... 700/257; 345/473; 345/474; 446/353; 700/245

(58) Field of Classification Search ..... 345/473, 345/474, 475; 446/301, 355, 353, 454; 700/245, 700/257

See application file for complete search history.

(56) References Cited

U.S. PATENT DOCUMENTS 5,021,878 A * 6/1991 Lang ..... 348/61
5,864,626 A 1/1999 Braun et al.
5,993,314 A * 11/1999 Dannenberg et al. ..... 463/1
6,729,934 B1 5/2004 Driscoll et al.
6,746,334 B1 6/2004 Barney
7,062,073 B1 * 6/2006 Tumey et al. ..... 382/118
2001/0037163 A1 * 11/2001 Allard ..... 700/245
2004/0259465 A1 * 12/2004 Wright et al. ..... 446/297
2005/0153624 A1 7/2005 Wieland
2005/0246063 A1 * 11/2005 Oonaka ..... 700/245

OTHER PUBLICATIONS

International Search Report and Written Opinion, Application No. PCT/US2008/076056, mailed Apr. 15, 2009, 8 pgs.

* cited by examiner

*Primary Examiner* — Khoi Tran
*Assistant Examiner* — Stephen Holwerda
(74) *Attorney, Agent, or Firm* — Farjami & Farjami LLP

(57) ABSTRACT

A system of distributed control of an interactive animatronic show includes a plurality of animatronic actors, at least one of the actors having a processor and one or more motors controlled by the processor. The system also includes a network interconnecting each of the actors, and a plurality of sensors providing messages to the network, where the messages are indicative of processed information. Each processor executes software that schedules and/or coordinates an action of the actor corresponding to the processor in accordance with the sensor messages representative of attributes of an audience viewing the show and the readiness of the corresponding actor. Actions of the corresponding actor can include animation movements of the actor, responding to another actor and/or responding to a member of the audience. The actions can result in movement of at least a component of the actor caused by control of the motor.

25 Claims, 4 Drawing Sheets

SYSTEM AND METHOD OF DISTRIBUTED CONTROL OF AN INTERACTIVE ANIMATRONIC SHOW

BACKGROUND OF THE INVENTION

1. Field of the Invention

The system and method relates to an interactive show, and more particularly, to distributed control of the interactive animatronic show.

2. Description of the Related Technology

An animatronic figure is a robotic figure, puppet, or other movable object that is animated via one or more electromechanical devices. The term "animated" is meant to be interpreted as to move to action. The electromechanical devices include electronics, mechanical, hydraulic, and/or pneumatic parts. Animatronic figures are popular in entertainment venues such as theme parks. For example, animatronic characters can be seen in shows, rides, or other events in a theme park. The animatronic character's body parts, such as the head and the arms, may generally move freely. Various animatronic systems have been created over a number of decades to control the animatronic figure.

Currently animatronic shows are controlled by centralized systems. These systems use precise synchronized clocks and dedicated high speed communication links to trigger events and playback content throughout the system. This existing approach is expensive, requires specialized infrastructure, suffers from having a single point of failure, and is difficult to scale to large and interactive shows. The standard approach involves a centralized show controller, generally a computer, that sends signals to individual components—be it sound, lighting, or figure motions. In theater, there is typically a person "at a control board" triggering events via protocols such as Musical Instrument Digital Interface (MIDI), Digital Multiplex (DMX), etc. In theme park style attractions, the control is typically from a dedicated control box.

SUMMARY OF CERTAIN INVENTIVE ASPECTS

In one embodiment, there is a system for distributed control of an interactive show, the system comprising a plurality of actors in the interactive show, at least one of the actors comprising a processor, and one or more motors controlled by the processor; a network interconnecting each of the actors; and a plurality of sensors providing messages to the network, wherein the messages are indicative of processed information; wherein each processor executes software that schedules and/or coordinates an action of the actor corresponding to the processor in accordance with the sensor messages representative of attributes of an audience viewing the show and the readiness of the corresponding actor.

In another embodiment, there is a method of distributing control of an interactive show having a plurality of actors and a network, the method comprising identifying one or more members of interest in an audience viewing the interactive show, broadcasting a first message representative of an attribute of the one or more members of interest to all the actors, processing the first message and a location of a particular actor so as initiate actions by the particular actor responsive to the one or more members of interest, and broadcasting a second message representative of the actions of the particular actor to other actors so that the other actors can respond to the actions.

DETAILED DESCRIPTION OF CERTAIN EMBODIMENTS

Figure 1:
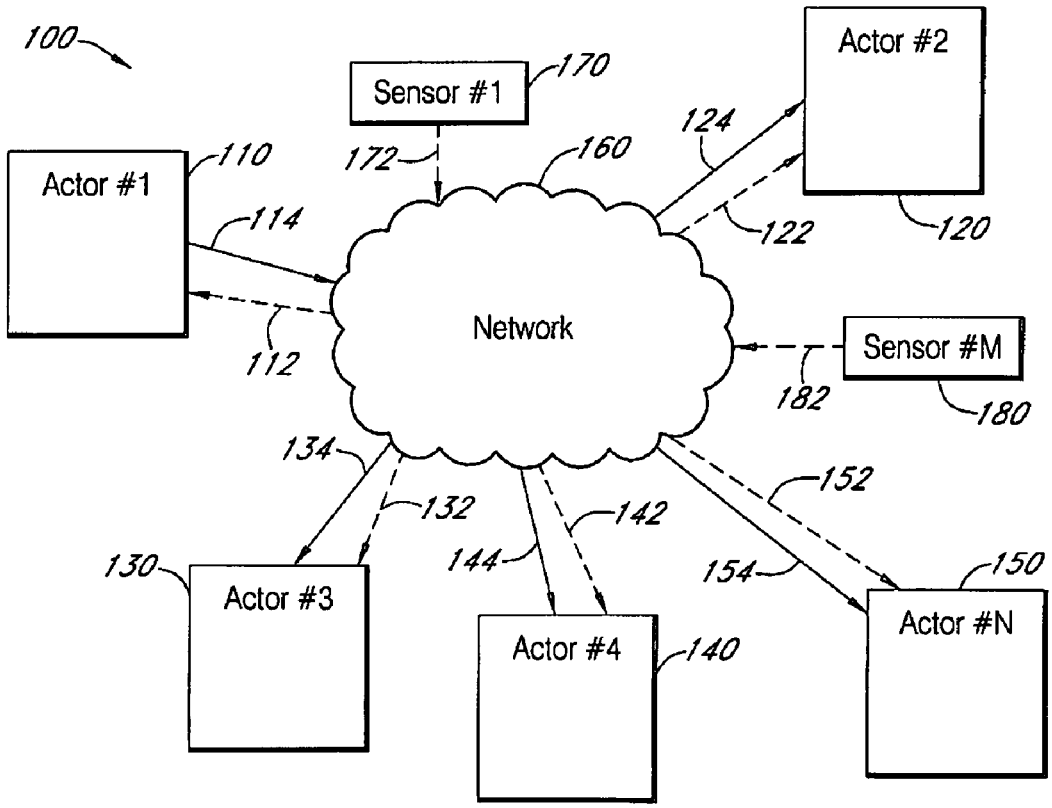
FIG. 1 is a block diagram of an example configuration of components of an embodiment of the system.

The following detailed description of certain embodiments presents various descriptions of specific embodiments of the invention. However, the invention can be embodied in a multitude of different ways as defined and covered by the claims. In this description, reference is made to the drawings wherein like parts are designated with like numerals throughout.

The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

The system is comprised of various modules, tools, and applications as discussed in detail below. As can be appreciated by one of ordinary skill in the art, each of the modules may comprise various sub-routines, procedures, definitional statements and macros. Each of the modules are typically separately compiled and linked into a single executable program. Therefore, the following description of each of the modules is used for convenience to describe the functionality of the preferred system. Thus, the processes that are undergone by each of the modules may be arbitrarily redistributed to one of the other modules, combined together in a single module, or made available in, for example, a shareable dynamic link library.

The system modules, tools, and applications may be written in any programming language such as, for example, C, C++, Python, BASIC, Visual Basic, Pascal, Ada, Java, HTML, XML, or FORTRAN, and executed on an operating system, such as variants of Windows, Macintosh, UNIX, Linux, QNX, VxWorks, or other operating system. C, C++, Python, BASIC, Visual Basic, Pascal, Ada, Java, HTML, XML and FORTRAN are industry standard programming languages for which many commercial compilers can be used to create executable code.

Definitions

The following provides a number of useful possible definitions of terms used in describing certain embodiments of the disclosed invention.

A network may refer to a network or combination of networks spanning any geographical area, such as a controller area network, local area network, wide area network, regional network, national network, and/or global network. The Internet is an example of a current global computer network. Those terms may refer to hardwire networks, wireless networks, or a combination of hardwire and wireless networks.

Hardwire networks may include, for example, fiber optic lines, cable lines, ISDN lines, copper lines, etc. Wireless networks may include, for example, cellular systems, personal communications service (PCS) systems, satellite communication systems, packet radio systems, and mobile broadband systems. A cellular system may use, for example, code division multiple access (CDMA), time division multiple access (TDMA), personal digital phone (PDC), Global System Mobile (GSM), or frequency division multiple access (FDMA), among others.

A computer or computing device may be any processor controlled device that permits access to the network, including terminal devices, such as personal computers, workstations, servers, clients, mini-computers, main-frame computers, laptop computers, a network of individual computers, mobile computers, palm-top computers, hand-held computers, set top boxes for a television, other types of web-enabled televisions, interactive kiosks, personal digital assistants, interactive or web-enabled wireless communications devices, mobile web browsers, or a combination thereof. The computers may further possess one or more input devices such as a keyboard, mouse, touch pad, joystick, pen-input-pad, gamepad and the like. The computers may also possess an output device, such as a video display and an audio output. One or more of these computing devices may form a computing environment.

These computers may be uni-processor or multi-processor machines. Additionally, these computers may include an addressable storage medium or computer accessible medium, such as random access memory (RAM), an electronically erasable programmable read-only memory (EEPROM), programmable read-only memory (PROM), erasable programmable read-only memory (EPROM), hard disks, floppy disks, laser disk players, digital video devices, compact disks, video tapes, audio tapes, magnetic recording tracks, electronic networks, and other techniques to transmit or store electronic content such as, by way of example, programs and data. In one embodiment, the computers are equipped with a network communication device such as a network interface card, a modem, or other network connection device suitable for connecting to the communication network. Furthermore, the computers can execute an appropriate operating system such as Linux, UNIX, QNX, any of the versions of Microsoft Windows, Apple MacOS, IBM OS/2 or other operating system. The appropriate operating system may include a communications protocol implementation that handles all incoming and outgoing message traffic passed over the network. In other embodiments, while the operating system may differ depending on the type of computer, the operating system will continue to provide the appropriate communications protocols to establish communication links with the network.

The computers may contain program logic, or other substrate configuration representing data and instructions, which cause the computer to operate in a specific and predefined manner, as described herein. In one embodiment, the program logic may be implemented as one or more object frameworks or modules. These modules may be configured to reside on the addressable storage medium and configured to execute on one or more processors. The modules include, but are not limited to, software or hardware components that perform certain tasks. Thus, a module may include, by way of example, components, such as, software components, object-oriented software components, class components and task components, processes, functions, attributes, procedures, subroutines, segments of program code, drivers, firmware, microcode, circuitry, data, databases, data structures, tables, arrays, and variables.

The various components of the system may communicate with each other and other components comprising the respective computers through mechanisms such as, by way of example, interprocess communication, remote procedure call, distributed object interfaces, and other various program interfaces. Furthermore, the functionality provided for in the components, modules, and databases may be combined into fewer components, modules, or databases or further separated into additional components, modules, or databases. Additionally, the components, modules, and databases may be implemented to execute on one or more computers. In another embodiment, some of the components, modules, and databases may be implemented to execute on one or more external computers.

The computing devices may communicate via network utilizing a number of various modes and protocols of communication. For example, such modes of communication can include a Universal Serial Bus (USB), Firewire, infrared signals, Bluetooth wireless communications, IEEE 802.2 signals, radio frequency signals such as those of frequency 900 megahertz or higher, straight-through and crossover Ethernet cables, switched packets or sockets transmission, token rings, frame relays, T-1 lines, DS connections, fiber optic connections, RJ-45 and RJ-11 connections, serial pin connections, ultrasonic frequency connections, and satellite communications. Other modes and protocols of communication are also possible and are within the scope of the present system.

Detailed Discussion

A computing environment is disclosed, which provides greater flexibility for controlling animatronic show systems than previously seen and provides the ability to produce life-like motions and provides a greater degree of fault tolerance. This computing environment can be applied to robotic systems generally and is not limited to only animatronic systems.

Various features of this computing environment are described below with respect to an animatronic show system. In one embodiment, the computing environment provides resources for different types of shows that the animatronic figure can perform combinations and sequencing of the movements in these shows to produce life-like movements, such as in response to an audience of the show. Distributed control of an interactive show can be realized by making each of the show components intelligent, that is, associating the show component with a small computer or processor allows it to be aware of both the show status and to communicate with other show components.

Each show component in the system can be associated with a small computer and local sensors, and can communicate using standard networking approaches. In certain embodiments, each component monitors the local environment, both its own status and the state of the show, and uses that to determine and deliver show content. Therefore, localized decisions are made based on the information that is locally available. Some components (actors) are more concerned with delivering show content, and others (sensors) are more concerned with monitoring, with still others (stage managers) more concerned with coordination and handling unexpected events. This is not a sharp distinction, but a continuum of responsibilities. While this approach can be used to deliver precise fixed shows, it lends itself particularly well to less regimented show content. Interaction involves responding to evolving situation around the actors, be it the reaction of the audience to the precise location and status of other portions of the system, for example, an object that is to be picked up.

It is the same ability that makes the system fault tolerant. If a component of the system fails, it is analogous to a performer that forgets their part or otherwise makes a mistake. In this distributed control system, the result of such an unexpected event is a flurry of messages (hidden from the audience) to resolve the "failure". For example a different actor could say the next line or part of the show could be skipped or lines added to cover up. Note that the system would be aware that it was "working around" parts of the system or was in some way not working perfectly. In a theme park environment, a show system is expected to be operational all day, often as much as sixteen hours nonstop, and then is shut down and checked at night. These non-fatal problems can then be resolved at that time.

The same capability allows for improvisation and enhancement of the show by responding to the audience and other local events. As each component performs its task, it sends messages to the other components telling them either its intentions (the actions that are being planned for the near future) or actions (e.g., portions of the show that have been initiated). This allows coordinated performances. Note that this is distinctly different from the existing approach that either amounts to synchronizing everyone's watch to a common time or a single controller telling each performer when to start saying each and every line.

Show components respond to messages based on their internal state. This provides both a simpler more fault tolerant approach to control as well as appearing more "natural" because of the small subtle variations that can occur. Sensors, such as, for example, cameras, can feed information to the animatronic actors. In certain embodiments, this information is not raw sensor readings, but processed information about the location or response of the audience as well as the rest of the system. Therefore, sensor information becomes another kind of message being sent around the network. Sensors themselves also have some ability to monitor their own status and inform the rest of the system. This allows, for example, an actor that typically waits for sensor input indicating an audience member has approached the actor to simply decide to deliver a line after waiting a particular amount of time because it appears that the sensor is broken.

FIG. 1 illustrates an example show system 100, which is configured for distributed control of different types of shows in an interactive life-like manner, and in certain embodiments, in real-time. A show can be a sequence of movements of one or more animatronics, such as an actor #1 (110), actor #2 (120), actor #3 (130), actor #4 (140) or actor #N (150), animated by the show system 100. In certain embodiments, the actors are each bidirectionally connected to a network 160, such as a controller area network (CAN) or a transmission control protocol/internet protocol (TCP/IP) network. The CAN is a broadcast, differential serial bus standard that is designed to be robust in electromagnetically noisy environments. Other types of networks (such as previously described) can be used in other embodiments. One or more sensors, such as sensor #1 (170) or sensor #M (180), are also bidirectionally connected to the network 160.

As shown as an example in FIG. 1, sensor 170, via a signal path 172, or sensor 180, via a signal path 182, sends a message generated in response to sensor data to the network 160. In one embodiment shown in FIG. 1, the network 160 passes the message to actor 1, via signal path 112, actor 2, via signal path 122, actor 3, via signal path 132, actor 4, via signal path 142, and actor N, via signal path 152. As shown as an example in FIG. 1, actor #1 (110), via signal path 114, can broadcast a message to the network 160 for distribution to actor #2 (120), via signal path 124, actor #3 (130), via signal path 134, actor #4 (140), via signal path 144, and actor #N (150), via signal path 154.

In one embodiment, a real-time evaluated scripting language is used to describe show elements. Show elements are theatric elements that can range from small motions and gestures up to complex interactive motions. These show elements contain sets of motions for the actor, such as actor 110, as well as audio and other computer controlled show components (not shown), such as lighting, video, curtain(s), and effects devices (e.g., fog machines). Show elements are typically built up, using the scripting language, by combining simpler component show elements to produce complex life-like motions.

One type of show is a puppetted show. The puppetted show is a sequence of motions that are operator-controlled, where an operator manually inputs the desired movements of the actor, such as actor 110, into the show system 100. Upon the user manually inputting each desired motion, the actor 110 produces a corresponding motion in a real-time fashion. The show system 100 instructs the actor 110 to produce the desired motion instantly or in a short time period after the user manually inputs the desired motion command. Therefore, the actor appears to be moving according to the desired motion as the user is entering the desired motion into the show system 100.

Another type of show is a fixed show. The fixed show is a recordation of pre-animated sequences that can be played back either once, repeatedly being activated by a trigger, or continuously in a loop. The operator can select a fixed show and animate the actor without having to input each movement while the show is playing, as the operator would do if providing a puppetted instruction. A few different ways exist for creating a fixed show. In one embodiment, the fixed show is a recordation of a user puppetting a sequence of movements. In another embodiment, the fixed show is a recordation of movements that a user enters through a graphical user interface (GUI). In another embodiment, motions are derived from other sources, such as deriving mouth positions from analyzing recorded speech. In another embodiment, motion data is derived from animation data from an animated movie. In another embodiment, a combination of these approaches is used. In one embodiment, the instructions for the fixed show are stored on a computer-readable medium.

In one embodiment, the user inputs the selection of the fixed show through a button or other type of selector (not shown) that instructs the show system 100 to animate the animatronic actor, e.g., actor 110, according to the pre-recorded motions of the fixed show that is selected. A plurality of buttons can be provided with each button representing a different fixed show selection. In another embodiment, the user inputs the selection of the fixed show with a touch screen display. In another embodiment, the user inputs the selection of the fixed show through a dial. In another embodiment, the user inputs the selection of the fixed show through voice commands into a microphone that operates in conjunction with voice recognition software.

The show system 100 provides the user with the ability to animate the actor, e.g., actor 110, according to a fixed show and a puppetted show simultaneously. If a fixed show provides an instruction to one actuator or motor of the actor while the puppetted sequence provides an instruction to a different actuator, both instructions are performed simultaneously to give the appearance that two different body parts are moving simultaneously. If the fixed show provides an instruction to the same actuator as the puppetted show, a composite motion for the actor is calculated.

Yet another type of show involves procedural animation, which is similar to, but distinct from, the scripting language previously described. In procedural animation, actions are computed by a software program. There are two canonical examples that are used. The first example is "vamping" (or an idle sequence) in which the animatronic figure looks around randomly if it is not responding to anything else. This is to prevent the animatronic figure from ever looking "dead". The other example of procedural animation is lip sync to live voice talent, which is associated with the previously described puppet control. A line that a human actor speaks into a microphone is processed based on the amplitude and pitch of the signal. The mouth position of the animatronic figure is computed and the audio is delayed a few tenths of millisecond so that the motion and audio are synchronized. This feature allows characters to talk to guests live while performing a mix of puppet, canned, and procedural animation.

Figure 2:
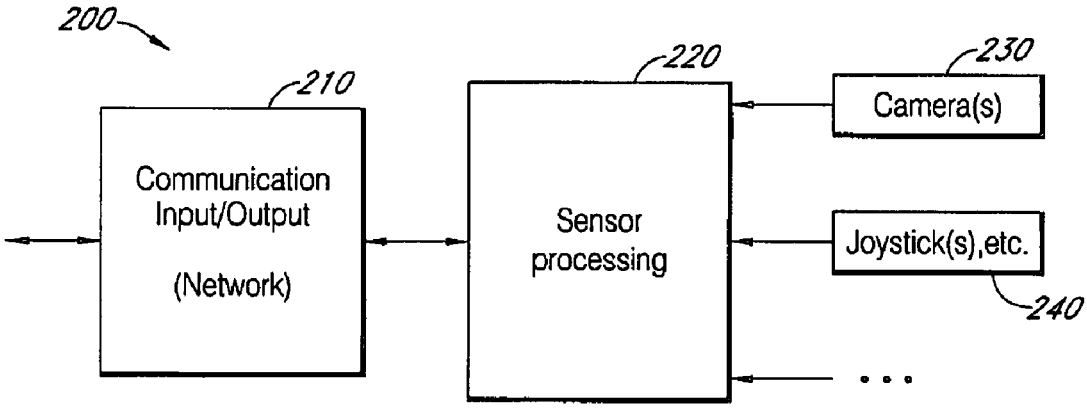
FIG. 2 is a block diagram of an example configuration of components of an embodiment of a sensor subsystem such as shown in FIG. 1.

Referring to FIG. 2, an example sensor subsystem 200, such as sensor 170 or 180 shown in FIG. 1, will be described. The sensor subsystem 200 is in data communication with the network 160 via a communication input/output component 210, such as a netMMC expansion board available from Gumstix. The network 160 can include a network switch, such as a model FS 116 16 port 10/100 desktop switch available from Netgear. The communication input/output 210 connects with a sensor processing component 220, which in one embodiment can be a computer. One or more sensors, such as one or more cameras 230, a joystick or gamepad 240, or other device connects to the sensor processing component 220.

In one example of a sensor subsystem 200, in one embodiment (see 570, FIG. 5), four Fire-i digital board cameras with a 4.3 mm lens (without IR coating) that are available from Unibrain can be the sensors. These cameras can be connected to a Firewire hub, such as a NN-H60112 hub available from SIIG, and then processed by a computer, such as a model xw8000 available from Hewlett-Packard. The four Firewire cameras can be configured in the ceiling of a show area looking down at the audience members or guests. The outputs of the cameras are processed by a single computer using a well-known "blob tracking" algorithm and merged into a single integrated view to find "interesting" objects (people) in the area. In certain embodiments, these blobs are then ranked based on their proximity (distance) from the show actors, their size, and their velocity. In one embodiment, an ad hoc metric is used for the ranking based on the size of the blob (must be larger than a threshold), velocity (higher is better), and location (proximity to the actor in question where closer is better). In this embodiment, the ranking is the product of the location, size and velocity, which logically, can be considered an "AND" operation. In certain embodiments, the cameras are downward looking to track guest location. In other embodiments, the cameras can be forward looking, particularly with face detection and tracking.

In the sensor subsystem 200 described above, once the object(s) of interest are identified, information about the objects is broadcast in message(s) to the actors via the network 160. In certain embodiments, the information includes the location of the object(s) of interest. In other embodiments, the information can include one or more of the following: data about where (e.g., a direction) the object of interest is looking, whether or not the object is talking, what the object is saying, and what the object is doing.

As another example of a sensor subsystem 200, a dual action gamepad available from Logitech can be connected to a USB port of a computer, such as a model E5400 computer available from Gateway. The gamepad can be used to control puppetted and/or fixed show actions of the actors. Certain functions or actions can be toggled on/off, which can be done for one or more actors selected via the gamepad. The gamepad can be used to trigger (start) a particular show. Other functionality can be controlled at various times via the gamepad. For example, a head turn of one of the actors can be directly controlled by one of the gamepad joysticks (control would cross fade to the joystick when the joystick started to move, and fade out after the joystick stopped moving for a second or more). Fixed animations could be triggered (such as "Bye").

In certain embodiments, the sensor subsystem 200 broadcasts the same information to each actor and show component, allowing each actor to use the information as the actor sees fit. For example, the cameras report the location to blobs (e.g., audience members) in world coordinates. Since each actor knows its own location in world coordinates, the actor can, if it so chooses, to use those two pieces of information to turn and look at guests or members of the audience as they move around. In certain embodiments, the system can operate using absolute coordinates, relative coordinates, or combinations of absolute and relative coordinates. For example, for broadcasting the position of the most interesting blob, a local calculation allows relative motion of the blob.

Other types of sensors are contemplated in other sensor subsystems. The other sensors can include:

- Microphones
  - single (level trigger, voice recognition)
  - sound localization using multiple microphones
- IR (infra red) sensors (motion sensors, break beams)
- Ultrasonic proximity sensors (distance sensors)
- Floor mats (pressure sensors)
- Laser range finders In certain shows and attractions, there is a large amount of sensor data information that is available and can be sent to the network to be broadcast to show components. This information can include data related to:

- track sensors (e.g., when a ride vehicle passes by) where some rides have RFID (radio frequency identifiers) for recognizing the vehicle, or a system where individual guests have unique RFID tags so the guests can be identified
- environmental sensors (e.g., when a door has closed, when guests are in an area (such as for safety concerns))
- synchronization with other show components (e.g., video, audio, lighting, effects (e.g. fog, water spritzers), set pieces (e.g., curtains, doors), time-or-day events) typically using SMPTE time-code
- "control tower" inputs, where rides typically have a control room or tower area that traditionally is high enough to see the entire ride. In the tower area, there are typically controls for starting/stopping and/or enabling/disabling the ride and often dispatch cars or individual effects.

Figure 3:
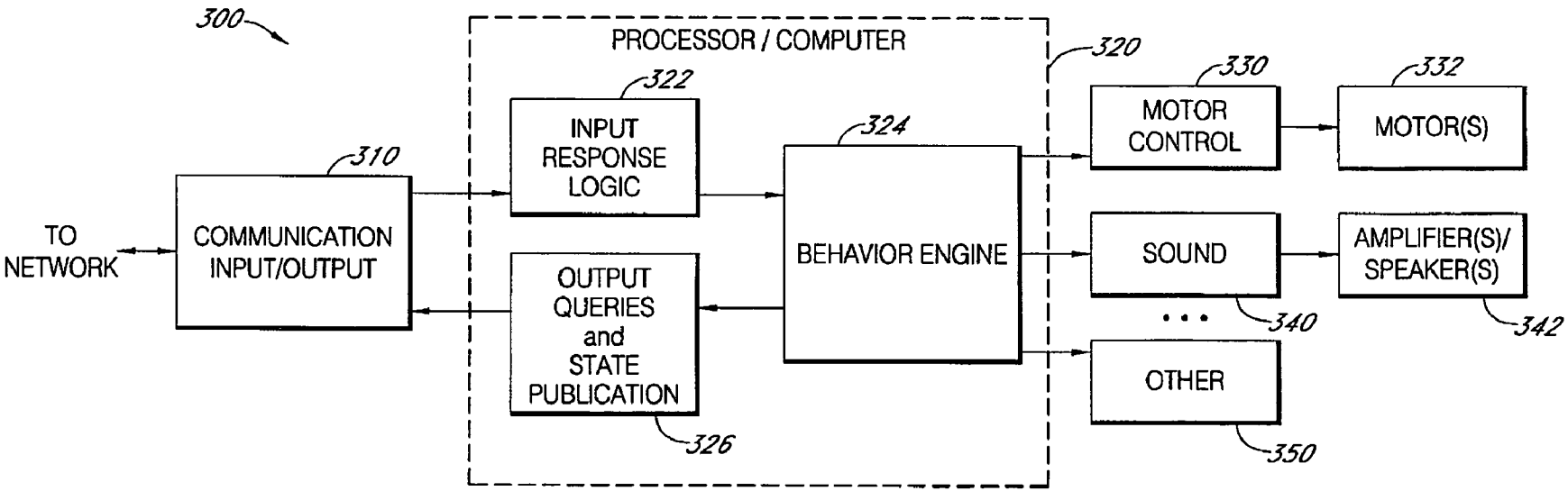
FIG. 3 is a block diagram of an example configuration of components of an embodiment of an actor subsystem such as shown in FIG. 1.

Referring to FIG. 3, an example of an actor subsystem 300 will be described. In certain embodiments, the actor subsystem 300 can be a motorized hand puppet including a small embedded computer, several motors and an amplifier with a speaker or other transducer. The actor subsystem 300 can communicate with other actor subsystems 300 via a network, such as the CAN.

In one embodiment, the actor subsystem 300 includes a communication input/output component 310 to communicate with the network 160 (FIG. 1). The communication input/output component 310 is connected to or is associated with computer or processor 320. In certain embodiments, the computer 320 includes an input response logic module 322 receiving input from the communication input/output component 310 and providing an output to a behavior engine 324. In certain embodiments, the input response logic module 322 can be a switch statement in software languages such as C, C++, C#, Python, and Java. Certain example operations performed by the behavior engine 324 will be described in conjunction with FIG. 4 below. The behavior engine 224 provides outputs such as motor control 330, sound 340 and other output(s) 350 for controlling actions of the actor. For example, the motor control 330 controls the motor(s) 332 of the actor so that the actor can move portions of the actor such as an arm or mouth, the entire actor is rotated, and other actions. Similarly, the sound 340 output by the behavior engine 324 drives amplifier(s) and speaker(s) 342. In the computer 320, the behavior engine 324 sends an output to an output queries and state publication module 326, which further communicates with the communication input/output component 310 so as to send messages to the network 160 (FIG. 1).

In one embodiment, the actor subsystem 300 can include a computer subsystem 320 available from Gumstix having a Gumstix connex 400xm computer motherboard; and a Gumstix roboaudio-th digital and analog I/O, RIC servo motor control, audio output. The communication input/output component 310 can be a netMMC 10/100 network, MC memory card adapter also available from Gumstix. The motors 332 can be a model HS-625MG available from Hitec. The audio subsystem 341 can include a model TPA3001D1 audio amplifier available from Texas Instruments, and a model NSW1-205-8A loudspeaker available from Aura Sound.

In certain embodiments, when the actor subsystems 300 are not being commanded to do anything else, they turn to look at the "most interesting" guest or member of the audience (blob). When enabled by the gamepad, for example, one of the actor subsystems 300, a blue dog puppet, can say "Hello" when a blob approaches (e.g., first gets closer than 1.5 meters).

In one embodiment, there can be three animatronic actor subsystems 300 including three puppets: a bird, a blue dog, and a pink dog. Puppets typically look at the puppet that's speaking. An example script can be as follows:

Blue: Alright everyone, just like we rehearsed. Welcome . . .
Pink: to
Bird: the
Blue: Open
Pink: House
Bird: eh . . . , from, eh, never mind, . . .
Blue: Birdy, you messed it up!
Bird: Okay, let's start again, one more time.
Blue: No no, we ruined it, it's over.
Bird: Start again, welcome
Blue: to
Pink: the
Bird: Open
Blue: House
Pink: from
Bird: R
Blue: and
Pink: D
Bird: That was pretty good.
Blue: That was pretty good
Pink: Hee, hee, hee, hee.

Figure 4:
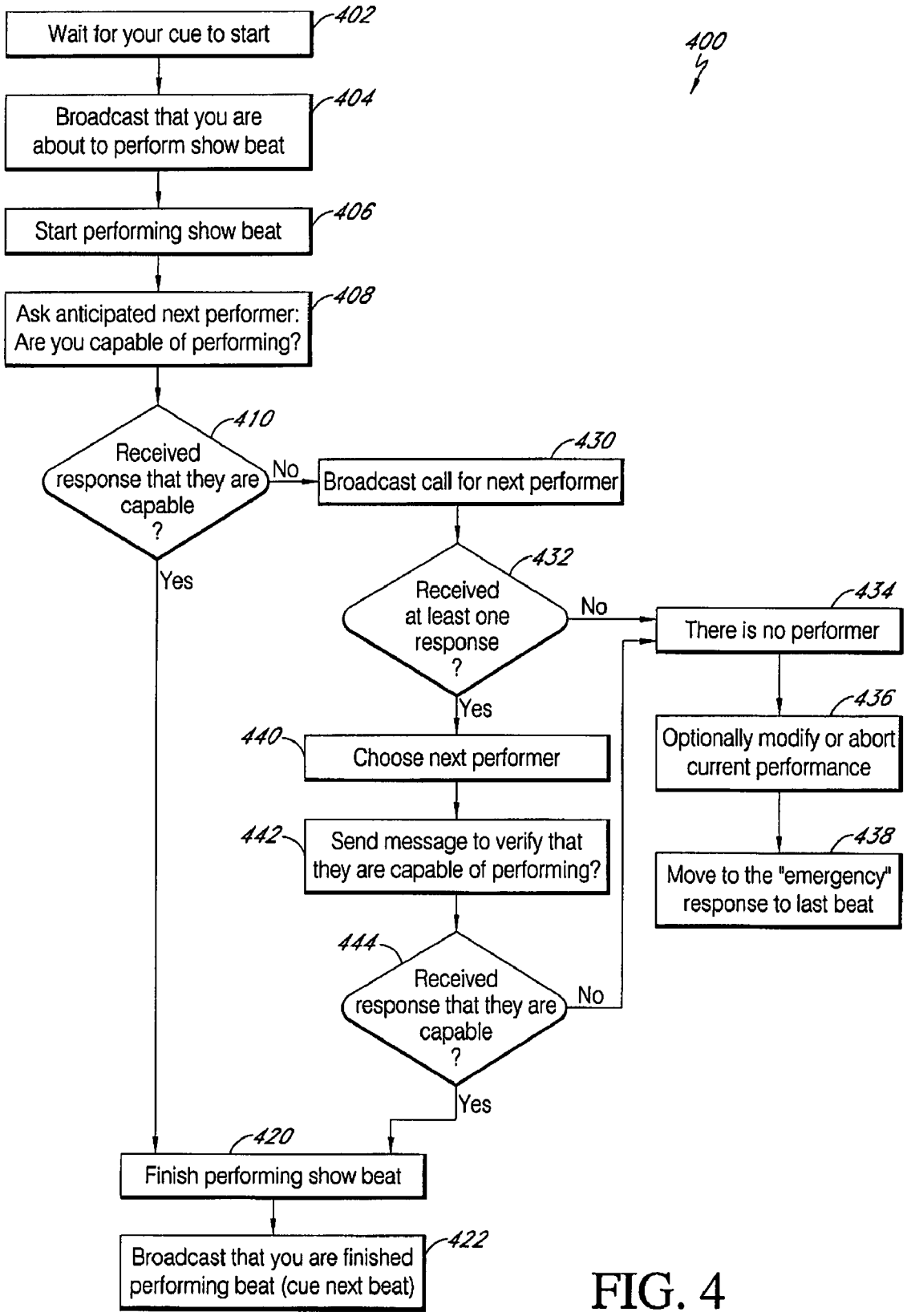
FIG. 4 is a flowchart of an example embodiment of operation of the actor subsystem such as shown in FIG. 3.

Referring to FIG. 4, a flowchart of an actor process 400 of certain example operations performed by the behavior engine 324 will be described. Performers send message(s) to the other performers (broadcast) when they are performing to allow or request other performers to respond. In certain embodiments, the performers are actor subsystems 300 (FIG. 3), but in other embodiments, the performers can be people, or combinations of people and actor subsystems 300. If a scripted response (such as a spoken line or a piece of a show), known as a beat, is expected by the performer that is performing, this is negotiated (e.g., an electronic handshake is performed) while the performance is carried out.

Beginning at a state 402, process 400 waits for a cue for a particular actor to start a performance, such as performing a show beat. Moving to state 404, process 400 broadcasts that the actor is about to perform a show beat. Advancing to state 406, the particular actor starts performing the show beat. Continuing at state 408, process 400 asks a question in anticipation of the next performer: Are you capable of performing? Proceeding to a decision state 410, process 400 determines whether a next performer is capable of performing via the received response. If a next performer is capable of performing, process 400 advances to state 420 where the particular actor finishes performing the current show beat. At the completion of state 420, process 400 moves to state 422, broadcasts that the particular actor is finished performing the show beat, and cues the next beat.

Returning to the discussion of the decision state 410, if a next performer is not capable of performing, process 400 advances to state 430 and broadcasts a call for a next performer. Proceeding to a decision state 432, process 400 determines if at least one response to the broadcast call is received. If at least one response to the broadcast call is not received, process 400 continues at state 434 where it is determined that there is no next performer. Moving to state 436, process 400 optionally modifies or aborts the current performance accordingly. Advancing to state 438, process 400 moves to an "emergency" response to the last beat. This could be, for example, covering for another performer such as speaking (playing) a phrase (e.g., "oh well"), or acknowledging that help is needed.

In general, an emergency can refer to most anything that is not what an actor expects. For example, if process 400 starts a beat, tries to queue the next performer and they are not available (or do not respond), that can be considered a minor emergency. If process 400 broadcasts a message and expects multiple responses and then does not receive any responses, that is a bad situation and can be considered to be a major emergency situation (e.g., are all the other robot actors dead?). An emergency situation can also involve an audience response. If the actor is talking to someone in the audience and they turn around and walk away while the actor is talking, that would be an emergency, where the system could consider interrupting the show beat and saying something in response to the person walking away. As for particular responses to use in state 438, the system can use several different classes of responses depending on various factors. For example, if no one in the audience laughs at an actor's joke, the actor could make an emergency response such as "hey, anybody out there?" or a similar line. Other classes of responses for anticipated emergencies can include dealing with hecklers, another actor dropping a line or not being available for the next line, and for general or undefined failures, such as where the actor could say "Whoa! That was weird!", or try to switch gears or cover a bad segue by saying "okay, okay, how about . . . ").

Returning to the discussion of the decision state 432, if at least one response to the broadcast call is received, process 400 continues at state 440 and chooses a next performer from among the performers that replied to the broadcast call. Advancing to state 442, process 400 sends a message to the chosen next performer to verify the capability of performing. Proceeding to a decision state 444, process 400 determines whether the chosen performer is capable of performing via the received response. If the chosen performer is capable of performing, process 400 moves to state 420 where the particular actor finishes performing the current show beat. However, if the chosen performer is not capable of performing, process 400 continues at state 434 as described above.

Figure 5:
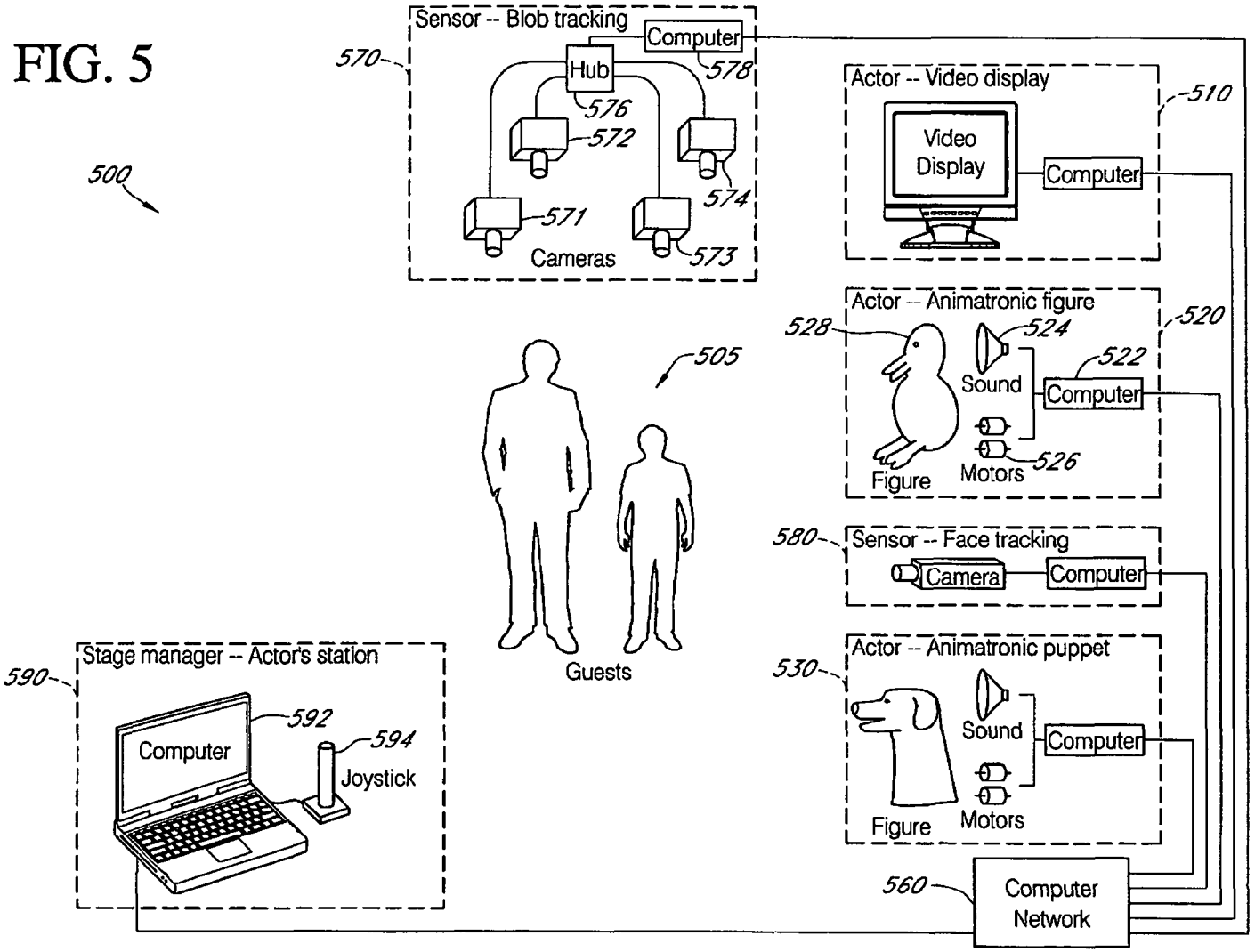
FIG. 5 is a block diagram of an example configuration of components of another embodiment of the system.

FIG. 5 illustrates another example show system 500, which is configured for distributed control of different types of shows in an interactive life-like manner, and in certain embodiments, in real-time. One or more guests 505 of the show can view one or more animatronics, such as an actor 510 (video display), actor 520 (animatronic figure), and actor 530 (animatronic puppet), which are animated by the show system 500. In certain embodiments, the actors are each bidirectionally connected to a network 560, such as a controller area network (CAN), a transmission control protocol/internet protocol (TCP/IP) network, or other type of network (such as previously described). One or more sensor subsystems, such as sensor 570 (blob tracking), sensor 580 (face tracking), and sensor 590 (stage manager), are also bidirectionally connected to the network 560.

The actors 510, 520 and 530 are examples of embodiments of the actor subsystem 300 described above in conjunction with FIG. 3. For example, actor 520 includes an animatronic FIG. 528 controlled by motors 526 and having a speaker (and optional amplifier) 524. A computer 522 is connected to the network 560 and provides motor control outputs and sound outputs for the animatronic figure motors 526 and speaker 524, respectively.

The sensor subsystems 570, 580 and 590 are examples of embodiments of the sensor subsystem 200 described above in conjunction with FIG. 2. For example, sensor 570 performs blob tracking and includes four cameras 571, 572, 573 and 574 connected to a hub 576. The hub 576 connects further to a computer 578 that interconnects with the network 560. Sensor 590 performs as a stage manager, and specifically as an actor's station, and includes a joystick (or other controller such as a gamepad) 594 in communication with a computer 592 that interconnects with the network 560. The stage manager 590 can be used to control puppetted and/or fixed show actions of the actors, and certain functions or actions can be toggled or/off, including starting a particular show.

The system 100 can be used in a variety of settings in a theme park or other type of entertainment or shopping venue. Examples include use of actor subsystems to entertain guests or customers in a queue line or store window; a show in a particular area or entrance to a ride or attraction, such as The Enchanted Tiki Room (Under New Management) in the Magic Kingdom where the actors perform a fixed show; and a petting zoo with actor subsystems that interact with guests and to each other.

Conclusion

While specific blocks, sections, devices, functions and modules may have been set forth above, a skilled technologist will realize that there are many ways to partition the system, and that there are many parts, components, modules or functions that may be substituted for those listed above.

While the above detailed description has shown, described, and pointed out the fundamental novel features of the invention as applied to various embodiments, it will be understood that various omissions and substitutions and changes in the form and details of the system illustrated may be made by those skilled in the art, without departing from the intent of the invention.

What is claimed is:

1. A system for distributed control of an interactive show, the system comprising:

a plurality of actors in the interactive show, at least one of the actors comprising:

a processor, and one or more motors controlled by the processor;

a network interconnecting each of the actors; and a plurality of sensors providing messages to the network, wherein the messages are indicative of processed information;

wherein the processor executes software that schedules and/or coordinates an action of the actor corresponding to the processor in accordance with the messages representative of attributes of a member of interest selected from a plurality of members of an audience viewing the show, and wherein the member of interest is selected from the plurality of members of the audience based on a size of the member of interest.

2. The system of claim 1, wherein the action of the corresponding actor comprises animation movements of the actor.

3. The system of claim 2, wherein the action results in movement of at least a component of the actor caused by control of the motor.

4. The system of claim 1, wherein the action of the corresponding actor comprises outputting sound or a projected effect.

5. The system of claim 1, wherein the action of the corresponding actor comprises responding to another actor or responding to a member of the audience.

6. The system of claim 1, wherein at least one of the actors further comprises an audio/video device and/or a transducer.

7. The system of claim 1, wherein at least one motor of the corresponding actor is configured to turn the actor toward a nearby member of the audience or to turn the actor toward another actor.

8. A system for distributed control of an interactive show, the system comprising:

a plurality of actors in the interactive show, at least one of the actors comprising:

a processor, and one or more motors controlled by the processor;

a network interconnecting each of the actors; and a plurality of sensors providing messages to the network, wherein the messages are indicative of processed information;

wherein the processor executes software that schedules and/or coordinates an action of the actor corresponding to the processor in accordance with the messages representative of attributes of a member of interest selected from a plurality of members of an audience viewing the show, and wherein the member of interest is selected from the plurality of members of the audience based on being closest to a particular actor as detected by at least one of the plurality of sensors.

9. The system of claim 8, wherein the at least one of the plurality of sensors broadcasts an identical message to the network for each actor.

10. The system of claim 9, wherein the identical message is indicative of the location of a member of the audience that exceeds a size threshold, is moving, and is close to a particular actor.

11. The system of claim 9, wherein the identical message is indicative of an attribute of a member of interest in the audience.

12. The system of claim 11, wherein the attribute includes information about at least one of where the member of interest is looking, whether the member of interest is talking, what the member of interest is saying, and what the member of interest is doing.

13. The system of claim 1, additionally comprising one or more show components connected to the network, at least one of the show components comprising a first processor.

14. The system of claim 13, wherein the show components include at least one of a show curtain, a show effects device, and show lighting.

15. The system of claim 1, wherein at least one of the plurality of sensors comprises a first processor configured to process sensor data into the messages.

16. The system of claim 1, wherein at least one of the sensors comprises a digital camera.

17. The system of claim 1, wherein one of the sensors comprises a game controller.

18. The system of claim 1, wherein at least one of the messages inhibits a particular action and/or inhibits one or more actors selected by use of the processor from performing actions.

19. A method of distributing control of an interactive show having a plurality of actors and a network, the method comprising:

selecting a member of interest from a plurality of members of an audience viewing the interactive show;

broadcasting a first message representative of an attribute of the member of interest to all the actors;

processing the first message and a location of a particular actor so as initiate actions by the particular actor responsive to the member of interest; and broadcasting a second message representative of the actions of the particular actor to other actors so that the other actors can respond to the actions;

wherein the selecting of the member of interest from the plurality of members of the audience is based on a size of the member of interest.

20. The method of claim 19, additionally comprising acknowledging the broadcast second message by one of the other actors so as to indicate a capability to perform actions.

21. The system of claim 1, wherein the member of interest is selected from the plurality of members of the audience further based on a location of the member of interest.

22. A system for distributed control of an interactive show, the system comprising:

a plurality of actors in the interactive show, at least one of the actors comprising:

a processor, and one or more motors controlled by the processor;

a network interconnecting each of the actors; and a plurality of sensors providing messages to the network, wherein the messages are indicative of processed information;

wherein the processor executes software that schedules and/or coordinates an action of the actor corresponding to the processor in accordance with the messages representative of attributes of a member of interest selected from a plurality of members of an audience viewing the show, and wherein the member of interest is selected from the plurality of members of the audience based on a moving velocity of the member of interest.

23. The method of claim 19, wherein the selecting of the member of interest from the plurality of members of the audience is further based on a location of the member of interest.

24. A method of distributing control of an interactive show having a plurality of actors and a network, the method comprising:

selecting a member of interest from a plurality of members of an audience viewing the interactive show;

broadcasting a first message representative of an attribute of the member of interest to all the actors;

processing the first message and a location of a particular actor so as initiate actions by the particular actor responsive to the member of interest; and broadcasting a second message representative of the actions of the particular actor to other actors so that the other actors can respond to the actions;

wherein the selecting of the member of interest from the plurality of members of the audience is based on a moving velocity of the member of interest.

25. A system for distributed control of an interactive show, the system comprising:

a plurality of actors in the interactive show, at least one of the actors comprising:

a processor, and one or more motors controlled by the processor;

a network interconnecting each of the actors; and a plurality of sensors providing messages to the network, wherein the messages are indicative of processed information;

wherein the processor executes software that schedules and/or coordinates an action of the actor corresponding to the processor in accordance with the messages representative of attributes of a member of interest selected from a plurality of members: of an audience viewing the show, and wherein the member of interest is selected from the plurality of members of the audience based on being detected by at least one of the plurality of sensors as moving the most.

* * * * *